US012486641B2

(12) United States Patent
Anahara et al.

(10) Patent No.: US 12,486,641 B2
(45) Date of Patent: Dec. 2, 2025

(54) CONSTRUCTION MACHINE INCLUDING A CONTROLLER PERFORMING AN OPERATION LIMITING PROCESS FOR LIMITING AN OPERATION FOR MOVING A WORKING DEVICE OF THE CONSTRUCTION MACHINE

(71) Applicant: HITACHI CONSTRUCTION MACHINERY CO., LTD., Tokyo (JP)

(72) Inventors: Keiichirou Anahara, Kasumigaura (JP); Naoki Hagiwara, Kasumigaura (JP); Kazuhiko Mizoguchi, Ishioka (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 192 days.

(21) Appl. No.: 17/640,860

(22) PCT Filed: Oct. 28, 2020

(86) PCT No.: PCT/JP2020/040447
§ 371 (c)(1),
(2) Date: Mar. 7, 2022

(87) PCT Pub. No.: WO2021/085477
PCT Pub. Date: May 6, 2021

(65) Prior Publication Data

US 2022/0341129 A1 Oct. 27, 2022

(30) Foreign Application Priority Data

Oct. 31, 2019 (JP) ..... 2019-198991

(51) Int. Cl.
*E02F 9/20* (2006.01)
*E02F 9/24* (2006.01)
*E02F 9/26* (2006.01)

(52) U.S. Cl.
CPC ..... *E02F 9/2033* (2013.01); *E02F 9/24* (2013.01); *E02F 9/262* (2013.01)

(58) Field of Classification Search
CPC . E02F 9/2033; E02F 9/24; E02F 9/262; E02F 3/435; E02F 9/2285; E02F 9/2296;
(Continued)

(56) References Cited

U.S. PATENT DOCUMENTS

2009/0114612 A1* 5/2009 Nelson ..... B66C 15/045 212/276
2014/0303855 A1* 10/2014 Umeda ..... E02F 9/123 701/50

(Continued)

FOREIGN PATENT DOCUMENTS

JP 11-209074 A 8/1999
JP 2986510 B2 12/1999

(Continued)

OTHER PUBLICATIONS

English machine translation of JP-2018145604-A (Year: 2018).*
International Search Report of PCT/JP2020/040447 dated Dec. 22, 2020.

*Primary Examiner* — Navid Z. Mehdizadeh
*Assistant Examiner* — Caitlin R McCleary
(74) *Attorney, Agent, or Firm* — MATTINGLY & MALUR, PC

(57) ABSTRACT

There is provided a construction machine capable of performing hanging work according to the intention of an operator. A hydraulic excavator 1 includes: an operating lever 420 for performing a turning operation; the cameras 61, 62, 63 for detecting any obstacle; and a controller 8 for controlling the operations of a vehicle body and a front working device 5. In the hydraulic excavator 1, in a case where the obstacle is detected by any of the cameras 61, 62, 63, the controller 8 performs an operation limiting process.

(Continued)

The hydraulic excavator 1 further includes a hook 53A, a mode selector switch 64 for switching the operation to a hanging work mode. In a case where the obstacle is detected by any of the cameras 61, 62, 63, the controller 8 disables the operation limiting process and controls the operation of the vehicle body or the front working device 5 according to the manipulated variable of the operating lever 420.

2 Claims, 10 Drawing Sheets

(58) Field of Classification Search
CPC ..... E02F 3/962; E02F 3/28; E02F 3/36; E02F 3/40; E02F 3/42; E02F 3/43; E02F 9/22; E02F 9/225; E02F 9/226; E02F 9/2029; E02F 9/2221; E02F 9/26; B66C 23/88
See application file for complete search history.

(56) References Cited

U.S. PATENT DOCUMENTS

| | | | | |
|---|---|---|---|---|
| 2018/0251956 | A1* | 9/2018 | Hoshaku | E02F 9/2037 |
| 2019/0023265 | A1* | 1/2019 | Takeda | B60W 10/18 |
| 2019/0024348 | A1 | 1/2019 | Hiekata | |
| 2020/0340208 | A1* | 10/2020 | Kitajima | B66C 23/86 |
| 2020/0385953 | A1* | 12/2020 | Sakuta | E02F 3/43 |
| 2021/0010243 | A1* | 1/2021 | Fukuoka | E02F 9/261 |

FOREIGN PATENT DOCUMENTS

| | | | | |
|---|---|---|---|---|
| JP | 2006-144349 | A | | 6/2006 |
| JP | 2007023486 | A | | 2/2007 |
| JP | 2011184965 | A | | 9/2011 |
| JP | 2016176289 | A | | 10/2016 |
| JP | 2017-155491 | A | | 9/2017 |
| JP | 2018145604 | A | * | 9/2018 |

* cited by examiner

CONSTRUCTION MACHINE INCLUDING A CONTROLLER PERFORMING AN OPERATION LIMITING PROCESS FOR LIMITING AN OPERATION FOR MOVING A WORKING DEVICE OF THE CONSTRUCTION MACHINE

TECHNICAL FIELD

The present invention relates to a construction machine capable of performing hanging work using a crane function.

BACKGROUND ART

The construction machine, in general, may sometimes encounter the following problem if there is an obstacle around a vehicle body. When some work is performed by using a working device mounted on the vehicle body or the vehicle body is moved forward or backward, the vehicle body or the working device may collide with the obstacle. For example, when the construction machine such as a hydraulic excavator that performs a turning operation is turned around or moved backward in particular, there is a blind spot for an operator seated in a cab seat to see properly even though a rear-view mirror or sideview mirror is used. In a case where there is some obstacle at such a blind spot, it is more likely that the vehicle body or the working device collides with the obstacle.

In this connection, an obstacle avoidance control device, for example, is disclosed in Patent Literature 1. In a case where when an upperstructure is turned or the vehicle body is moved backward, an obstacle is located in a collision prevention region previously set for the upperstructure and an operation tool is so operated as to move the upperstructure or the vehicle body in a direction toward the obstacle, the obstacle avoidance control device stops the operation by the operation tool so as to avoid collision with the obstacle.

In order to exhibit various functions, the hydraulic excavator sometimes performs, in addition to excavation work, hanging work using the crane function (sometimes referred to as movable crane work function) as an option function. Some of the hydraulic excavators equipped with the obstacle avoidance control device is further equipped with the crane function.

CITATION LIST

Patent Literature

Patent Literature 1: Japanese Unexamined Patent Application Publication No. 2007-023486

SUMMARY OF INVENTION

Technical Problem

If the obstacle avoidance control device is actuated during the hanging work using the crane function, the operation speed may be slowed down or the operation may be abruptly stopped against the intention of the operator, resulting in wide swing of a hanging load from an end of the working device. In some cases, the hanging load may be disengaged from a hanging attachment and fall.

It is therefore an object of the present invention to provide a construction machine capable of performing the hanging work according to the intention of the operator.

Solution to Problem

According to an aspect of the present invention for achieving the above object, a construction machine includes: a vehicle body; a working device attached to the vehicle body; an operating device for operating the vehicle body and the working device; an obstacle detection sensor for detecting any obstacle present around the vehicle body; and a controller for controlling the operations of the vehicle body and the working device, the controller performing an operation limiting process for limiting an operation based on a manipulated variable of the operating device in a case where the obstacle detection sensor detects the obstacle, the construction machine further including: a hanging attachment attached to the working device; and a mode selection device for switching to a hanging work mode to perform hanging work using the hanging attachment, the construction machine having a configuration wherein in a case where the obstacle detection sensor detects the obstacle during the hanging work mode, the controller disables the operation limiting process and controls the operation of the vehicle body or the working device according to the manipulated variable of the operating device.

Advantageous Effects of Invention

According to the present invention, the construction machine can perform the hanging work according to the intention of the operator. These and other objects, features, and advantages of the present invention will become apparent from the following description of the embodiments.

DESCRIPTION OF EMBODIMENT

A crawler type hydraulic excavator as a construction machine according to one embodiment of the present invention will be described as below.

Configuration of Hydraulic Excavator 1

First, a configuration of a hydraulic excavator 1 is described with reference to FIG. 1 to FIG. 3.

Figure 1:
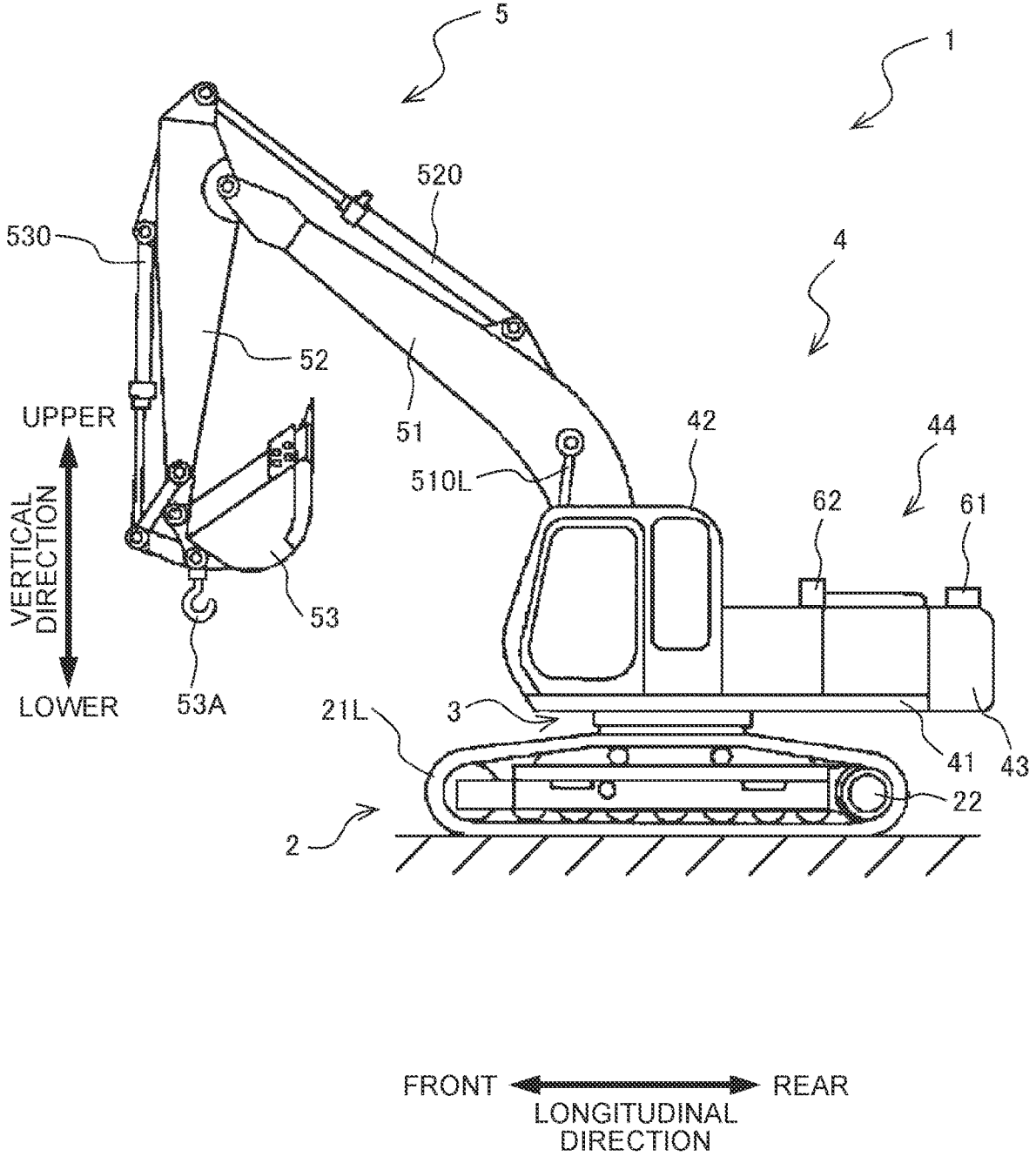
FIG. 1 is an external side view showing an exemplary configuration of a hydraulic excavator according to the embodiments of the present invention.

FIG. 1 is an external side view showing an exemplary configuration of a hydraulic excavator 1 according to the embodiments of the present invention. FIG. 2 is a top view of the hydraulic excavator 1 of FIG. 1 as seen from above. FIG. 3 is a hydraulic circuit diagram related to a swing motor 30.

The hydraulic excavator 1 includes: an undercarriage 2; an upperstructure 4 rotatably mounted on the undercarriage 2 via a swing gear 3; and a front working device 5 attached to a front part of the upperstructure 4 and adapted to perform the excavation work.

The undercarriage 2 includes: a matched pair of crawlers 21L, 21R; and a drive motor 22 for rotationally driving these crawlers 21L, 21R. A vehicle body is moved by means of the crawlers 21L, 21R rotated by a drive force of the drive motor 22 as maintained in contact with the ground surface. It is noted that the drive motor 22 is provided on both the right side and the left side in correspondence to the crawlers 21L, 21R, respectively. However, only the drive motor 22 for rotationally driving the left crawler 21L is shown in the figure. Further, the undercarriage 2 does not necessarily have to be of the crawler type, and may be of a wheel type.

The upperstructure 4 includes: a swing frame 41; a cab 42 where an operator is on board; a counterweight 43 for keeping a balance with the front working device 5 so that the vehicle body does not tilt; a machine room 44 for accommodating therein machinery such as engine and hydraulic pump; and a tank room 45 for accommodating therein a fuel tank and the like.

On the swing frame 41, the cab 42 is disposed at a front part, the counterweight 43 is disposed at a rear part, and the machine room 44 is disposed between the cab 42 and the counterweight 43. The tank room 45 is disposed at place in front of the machine room 44 and lateral to the cab 42. In the hydraulic excavator 1, the front working device 5 is disposed at a center with respect to a horizontal direction thereof. The cab 42 is disposed on the left side of the front working device 5 while the tank room 45 is disposed on the opposite side (the right side) of the front working device 5 from the cab 42.

The superstructure 4 turns in a horizontal direction as rotatably driven by the swing motor 30 (see FIG. 3) of the swing gear 3. Specifically, as shown in FIG. 3, the swing motor 30 is connected to a variable displacement type main pump 71 driven by an engine 70, so that the motor 30 is driven into rotation by hydraulic oil supplied from the main pump 71.

A directional control valve 72 which controls a flow (direction and flow rate) of the hydraulic oil discharged from the main pump 71 and supplied to the swing motor 30 is interposed between the main pump 71 and the swing motor 30. The directional control valve 72 includes: a first changeover position L to forwardly rotate the swing motor 30; a second changeover position R to backwardly rotate the swing motor 30; and a neutral position N to connect the main pump 71 to a hydraulic oil tank 73 so as to lead the hydraulic oil discharged from the main pump 71 to the hydraulic oil tank 73. The directional control valve 72 is a pilot-operated flow control valve which is switched to the first changeover position L, the second changeover position R, or the neutral position N by applying pilot pressure oil to a left or right oil chamber.

The pilot pressure oil applied to the directional control valve 72 is discharged from a pilot pump 74 driven by the engine 70 and generated as depressurized according to a manipulated variable of an operating lever 420. In a case where the operating lever 420 shown in FIG. 3 is tilted leftward, pilot pressure oil according to the manipulated variable is generated. The generated pilot pressure oil is led to a first pilot line 701 to be applied to the left oil chamber of the directional control valve 72. Thus, the directional control valve 72 is switched to the first changeover position L so that the swing motor 30 is rotated forward while the upperstructure 4 rotates leftward.

Figure 3:
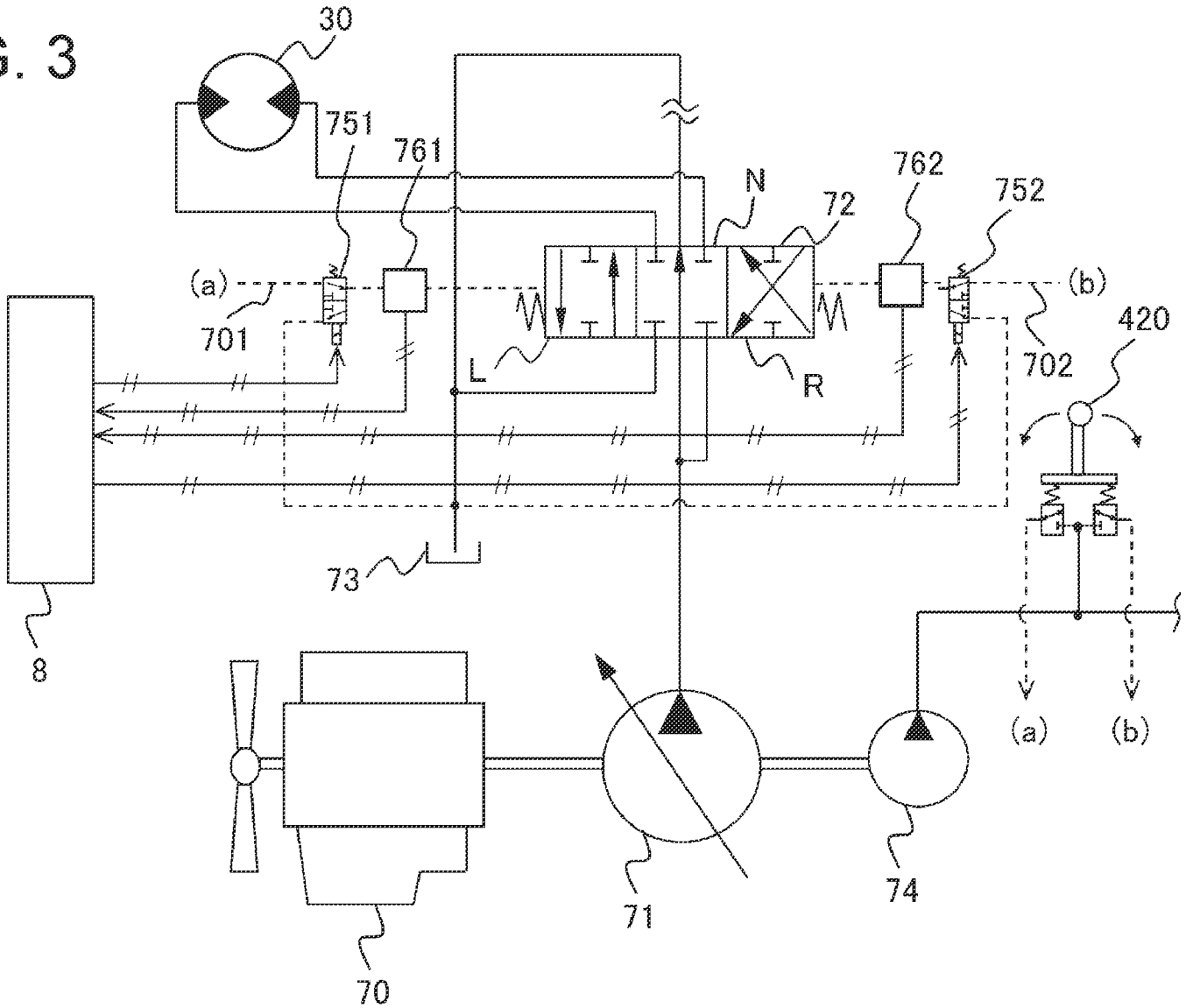
FIG. 3 is a hydraulic circuit diagram related to a swing motor.

In a case where the operating lever 420 shown in FIG. 3 is tilted rightward, on the other hand, pilot pressure oil according to the manipulated variable is generated. The generated pilot pressure oil is led to a second pilot line 702 to be applied to the right oil chamber of the directional control valve 72. Thus, the directional control valve 72 is switched to the second changeover position R so that the swing motor 30 is rotated backward while the upperstructure 4 rotates rightward.

As shown in FIG. 1, the front working device 5 includes: a boom 51, a base end section of which is rotatably attached to the swing frame 41; an arm 52 rotatably attached to a distal end of the boom 51; and a bucket 53 rotatably attached to a distal end of the arm 52.

The front working device 5 further includes: a pair of boom cylinders 510L, 510R interconnecting the swing frame 41 with the boom 51 so as to drive the boom 51; an arm cylinder 520 interconnecting the boom 51 with the arm 52 so as to drive the arm 52; a bucket cylinder 530 interconnecting the arm 52 with the bucket 53 so as to drive the bucket 53; and a plurality of pipelines (not shown) for leading the hydraulic oil to these cylinders 510L, 510R, 520, 530.

Specifically, the boom cylinders 510L, 510R vertically rotate (elevate) the upperstructure 4 relative to the upperstructure 4 by elongating and contracting the rod. The arm cylinder 520 rotates the arm 52 back and forth relative to the boom 51 by elongating and contracting the rods. The bucket cylinder 530 rotates the bucket 53 back and forth relative to the arm 52 by elongating and contracting the rods.

The bucket 53 is used for scooping load such as earth and sand and unloading the load onto a predetermined place. The bucket 53 can be replaced with an attachment such as a grapple for grappling lumber, rock, waste and the like, and a breaker for rock excavation. This permits the hydraulic excavator 1 to perform a variety of work including excavation, fracturing, and the like by using an attachment suitable for the type of work.

The hydraulic excavator 1 is adapted to perform the hanging work using a mobile crane function. As shown in FIG. 1, the bucket 53 has a hook 53A, as a hanging attachment for hanging a load, attached to a connection part with the arm 52. The hanging work is performed with the bucket 53 in a tilted state where the hook 53A projects lower (in the state shown in FIG. 1). To retract the hook 53A, the hook is rotated toward the arm 52 about the connection with the bucket 53 as the rotation center.

The hydraulic excavator 1 is characterized by performing a turning operation. However, it is inevitable that there is a blind spot for the operator seated in the cab seat to see properly even by means of the rear-view mirror or sideview mirror. In a case where there is an obstacle at such a place (e.g., worker(s) around the hydraulic excavator 1, or another vehicle than the hydraulic excavator 1), the hydraulic excavator 1 may collide with the obstacle.

Figure 2:
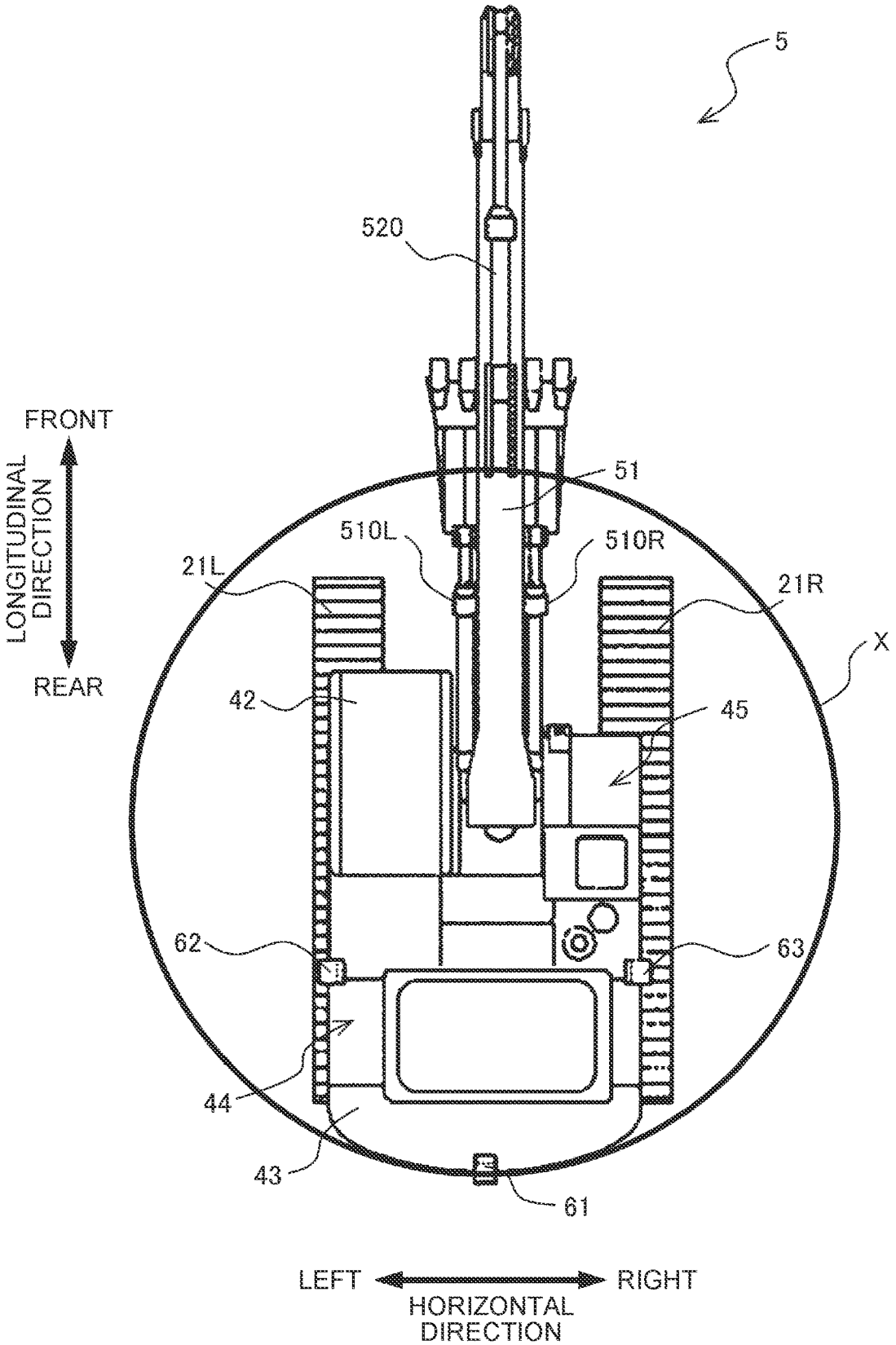
FIG. 2 is a top view of the hydraulic excavator of FIG. 1 as seen from above.

In a case where the upperstructure 4 turns, a rear end of the counterweight 43 describes a trajectory X as shown in FIG. 2. An area enclosed by the trajectory X is a blind area for the operator when the upperstructure 4 is performing the turning operation. If any obstacle exists in the area enclosed by the trajectory X, the turning upperstructure 4 collides with the obstacle.

The upperstructure 4 is provided with: a rear camera 61 mounted on the rear end of the counterweight 43; a left camera 62 mounted on a left side of the machine room 44; and a right camera 63 mounted on a right side of the machine room 44. These rear camera 61, left camera 62, and right camera 63 serve to detect an obstacle existing around the vehicle body. Each of the rear camera 61, the left camera 62, and the right camera 63 is a stereo camera as one mode of obstacle detection sensor. However, these cameras do not necessarily have to be the stereo cameras, and may be other cameras such as milliwave sensors or infrared sensors. It is noted that only the rear camera 61 and the left camera 62 are shown in FIG. 1.

An obstacle avoidance control system is adopted by the hydraulic excavator 1. According to the system, the area enclosed by the trajectory X is previously set for the vehicle body as a potential collision area with the vehicle body. In a case where an obstacle detected by the rear camera 61, the left camera 62, or the right camera 63 is located in this set area and the upperstructure 4 turns in a direction toward the obstacle, the obstacle avoidance control system limits (or slows down or stops) the turning operation so as to avoid collision with the obstacle.

As shown in FIG. 3, a first solenoid reducing valve 751 which depressurizes the pilot pressure oil led to the first pilot line 701 based on a limit command signal outputted from a controller 8, 8A, 8B according to the embodiment to be described hereinafter is disposed on the first pilot line 701. Further, a first pressure sensor 761 for detecting a pressure on the left oil chamber of the directional control valve 72 is disposed on a downstream side of the first solenoid reducing valve 751 (between the first solenoid reducing valve 751 and the directional control valve 72).

Similarly, a second solenoid reducing valve 752 which depressurizes the pilot pressure oil led into the second pilot line 702 based on the limit command signal outputted from the controller 8, 8A, 8B is disposed on the second pilot line 702. Further, a second pressure sensor 762 for detecting a pressure on the right oil chamber of the second solenoid reducing valve 752 is disposed on a downstream side of the second solenoid reducing valve 752 (between the second solenoid reducing valve 752 and the directional control valve 72).

The obstacle avoidance control system operates to drive the first solenoid reducing valve 751 and the second solenoid reducing valve 752 so that the directional control valve 72 is switched to the neutral position N regardless of the manipulation of the operating lever 420. Accordingly, the hydraulic oil discharged from the main pump 71 is not supplied to the swing motor 30 but returned to the hydraulic oil tank 73. Hence, the turning operation of the hydraulic excavator 1 is forcibly stopped. Therefore, the obstacle avoidance control system of the hydraulic excavator 1 is switched from "able" state to "disable" state based on a command signal outputted from the controller 8, 8A, 8B to the first solenoid reducing valve 751 and the second solenoid reducing valve 752.

Next, a description is made on a functional configuration of the controller 8, 8A, 8B according to the embodiments. The controller 8, 8A, 8B provides obstacle avoidance control not only when the hydraulic excavator 1 performs the turning operation but also when the vehicle body moves forward or backward or the front working device 5 is operated. However, these operations proceed according to the same flow. Hence, the description is made by way of example of the turning operation and the description of the other operations is dispensed with. In the case of the forward or backward movement of the vehicle, for example, a range within 1 m forward from a front end of the vehicle body or a range within 1 m backward from a rear end of the vehicle body is stored in the controller 8, 8A, 8B as a potential vehicle/obstacle collision area.

First Embodiment

A controller 8 according to a first embodiment of the present invention is described with reference to FIG. 4 and FIG. 5.

Configuration of Controller 8

First, a configuration of the controller 8 is described with reference to FIG. 4.

Figure 4:
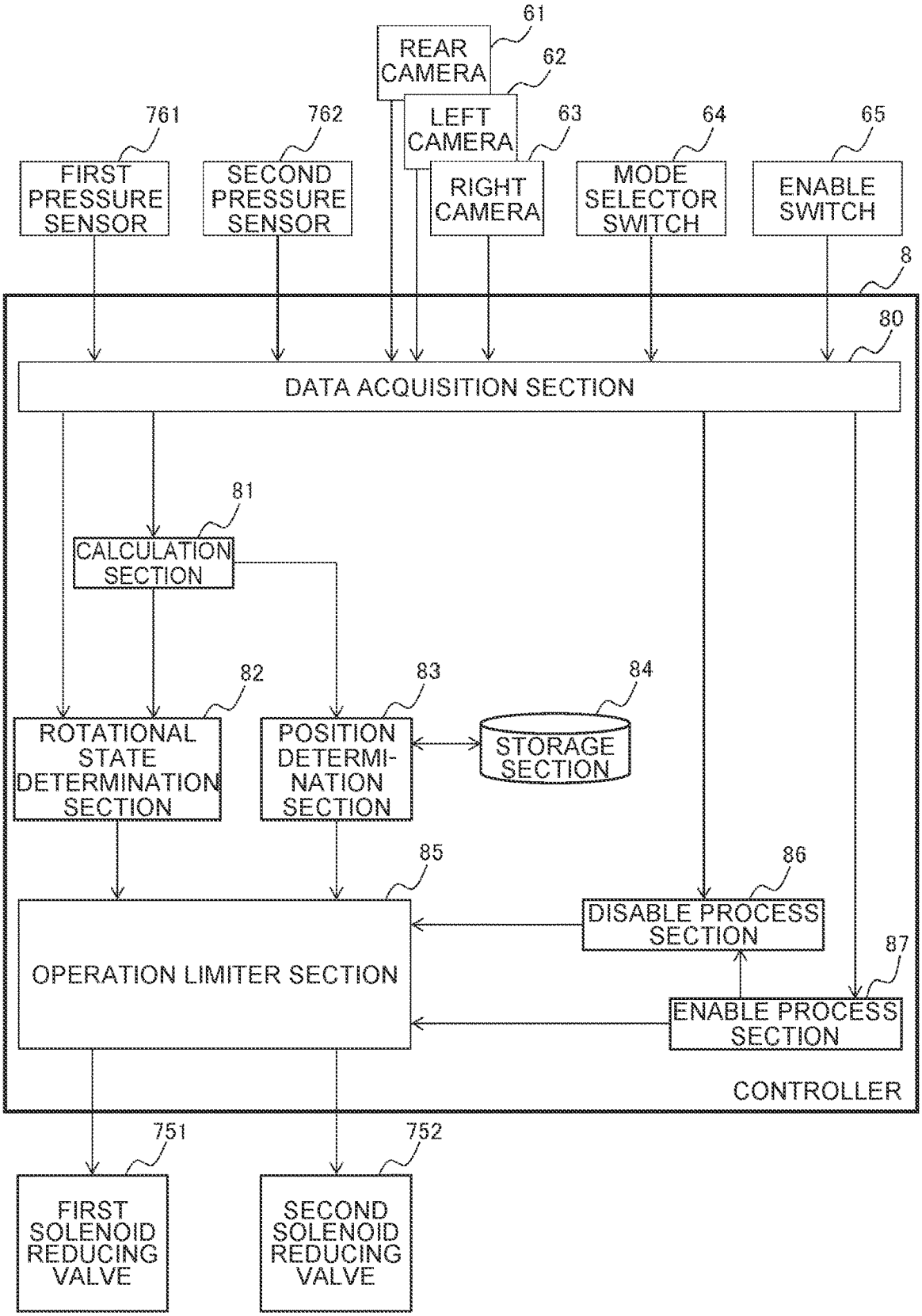
FIG. 4 is a functional block diagram showing the functions of a controller according to a first embodiment hereof.

FIG. 4 is a functional block diagram showing functions of the controller 8 according to the first embodiment.

The controller 8 is constituted of interconnecting a CPU, an RAM, an ROM, an input I/F, and an output I/F via buses. The operating devices such as a mode selector switch 64 and an enable switch 65, and a variety of sensors such as the first pressure sensor 761, the second pressure sensor 762, the rear camera 61, the left camera 62, and the right camera 63 are connected to the input I/F, while the first solenoid reducing valve 751 and the second solenoid reducing valve 752 are connected to the output I/F.

The mode selector switch 64 is disposed in the cab 42, and is operated by the operator when performing the hanging work using the hook 53A. This mode selector switch 64 is equivalent to a mode selection device which switches the operation to a hanging work mode to perform the hanging work using the hook 53A, and outputs a switching signal to the controller 8. It is noted that the mode selector switch 64 does not necessarily have to be disposed in the cab 42, and may be disposed at the hook 53A, for example.

The enable switch 65 is disposed in the cab 42 and is equivalent to an enable device which outputs an enable signal to enable an operation limiting process performed in the controller 8 during the hanging work mode. The specific details of the operation limiting process performed in the controller 8 will be described hereinafter.

In this hardware configuration, the function of the controller 8 is implemented by the cooperation of the control program and the hardware. Specifically, the CPU retrieves a control program (software) stored in a recording medium such as an ROM, an HDD, or an optical disk, expands the retrieved program on the RAM, and executes the expanded control program.

The embodiment illustrates the controller 8 as a computer constituted of a combination of software and hardware, but is not limited to this. For example, an integrated circuit implementing functions of a control program executed by the hydraulic excavator 1 may be used as a different example of computer configuration.

The controller 8 includes: a data acquisition section 80, an calculation section 81, a rotational state determination section 82, a position determination section 83, a storage section 84, an operation limiter section 85, a disable process section 86, and an enable process section 87.

The data acquisition section 80 acquires: the switching signal outputted from the mode selector switch 64; the enable signal outputted from the enable switch 65; the obstacle detected by the rear camera 61, left camera 62 or the right camera 63; and data related to the pilot pressure detected by the first pressure sensor 761 and the second pressure sensor 762.

Based on the data related to the obstacle acquired by the data acquisition section 80, the calculation section 81 calculates a distance from the vehicle body to the obstacle and an azimuth direction of the obstacle relative to the vehicle body. The calculation of the positional relation between the vehicle body and the obstacle does not necessarily have to be performed by the controller 8. Alternatively, the rear camera 61, the left camera 62, and the right camera 63 may perform the calculations before outputting the data related to the calculation results to the controller 8.

Based on the pilot pressure acquired by the data acquisition section 80 and the azimuth direction of the obstacle relative to the vehicle body as calculated by the calculation section 81, the rotational state determination section 82 determines whether or not the operating lever 420 (see FIG. 3) is so manipulated as to move the vehicle body toward the obstacle.

Based on the distance from the vehicle body to the obstacle as calculated by the calculation section 81, the position determination section 83 determines whether or not the obstacle is located in the area enclosed by the trajectory X (see FIG. 2). The area enclosed by the trajectory X, namely the potential vehicle/obstacle collision area is previously stored in the storage section 84.

In a case where the rotational state determination section 82 determines that the operating lever 420 is so manipulated as to move the vehicle body toward the obstacle and the position determination section 83 determines that the obstacle is located in the area enclosed by the trajectory X, the operation limiter section 85 outputs, to each of the first solenoid reducing valve 751 and the second solenoid reducing valve 752, an operation limit signal for limiting an operation based on the manipulated variable of the operating lever 420 (execution of the operation limiting process).

In a case where the data acquisition section 80 acquires the switching signal from the mode selector switch 64, or when the hydraulic excavator is in the hanging work mode, the disable process section 86 disables the operation limiting process by the operation limiter section 85 (execution of a disabling process). Therefore, when the data acquisition section 80 acquires the switching signal from the mode selector switch 64, the operation limiter section 85 does not perform the operation limiting process even though the rotational state determination section 82 determines that the operating lever 420 (see FIG. 3) is so manipulated as to move the vehicle body toward the obstacle and the position determination section 83 determines that the obstacle is located in the area enclosed by the trajectory X.

In a case where the data acquisition section 80 acquires the enable signal from the enable switch 65, the enable process section 87 cancels the disabling process by the disable process section 86 and enables the operation limiting process by the operation limiter section 85. Specifically, when the data acquisition section 80 acquires the enable signal from the enable switch 65, the disable process section 86 does not perform the disabling process even in a case where the switching signal from the mode selector switch 64 is acquired. Therefore, the operation limiter section 85 performs the operation limiting process.

Process in the Controller 8

Next, a specific flow of operations performed in the controller 8 is described with reference to FIG. 5 and FIG. 6.

Figure 5:
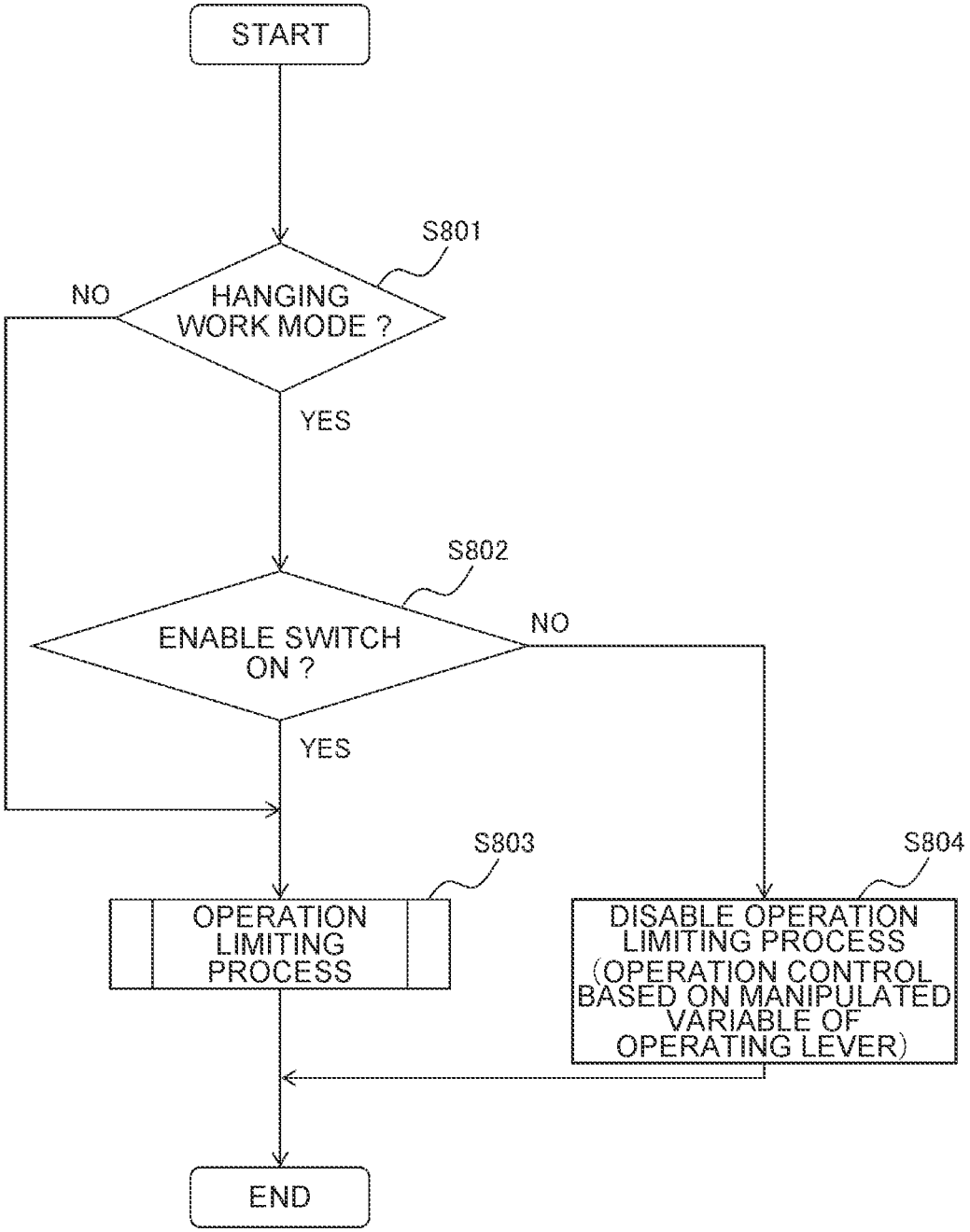
FIG. 5 is a flow chart showing a flow of the whole process performed by the controller according to the first embodiment hereof.

FIG. 5 is a flow chart showing a flow of the whole process performed by the controller 8 according to the first embodiment. FIG. 6 is a flow chart showing a flow of the operation limiting process (Step S803) performed by the controller 8 according to the first embodiment.

As shown in FIG. 5, the controller 8 first determines whether or not the switching signal from the mode selector switch 64 is acquired by the data acquisition section 80, or whether the excavator is in the hanging work mode or not (Step S801).

In a case where it is determined in Step S801 that the excavator is in the hanging work mode (Step S801/YES), the controller determines whether or not the enable signal from the enable switch 65 is acquired by the data acquisition section 80 or whether the enable switch 65 is turned ON or not (step S802). In a case where it is determined in Step S801 that the excavator is not in the hanging work mode (Step S801/NO), the operation proceeds to the operation limiting process by the operation limiter section 85 (Step S803). The process in the controller 8 ends.

In a case where it is determined in Step S802 that the enable switch 65 is turned ON (Step S802/YES), the disabling process by the disable process section 86 is cancelled by the enable process section 87. Hence, the operation proceeds to the operation limiting process by the operation limiter section 85 (Step S803) and the process in the controller 8 ends.

On the other hand, in a case where it is determined in Step S802 that the enable switch 65 is not turned ON (the enable switch 65 is left turned OFF) (Step S802/NO), the operation proceeds to the disabling process by the disable process section 86 (disabling the operation limiting process) (Step S804) and the process in the controller ends. Thus, the controller 8 controls the turning operation according to the manipulated variable of the operating lever 420.

Figure 6:
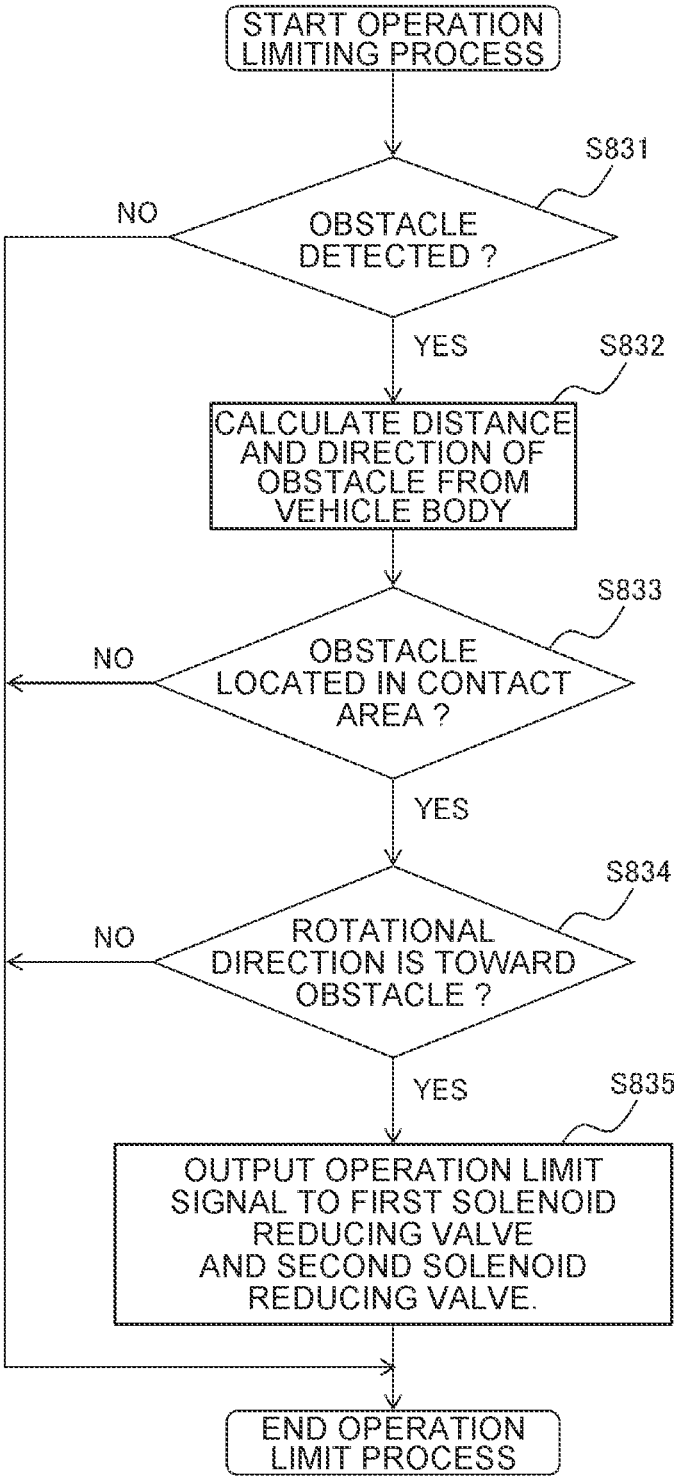
FIG. 6 is a flow chart showing a flow of an operation limiting process performed by a controller according to the first embodiment hereof.

In the operation limiting process (Step S803), as shown in FIG. 6, the controller 8 determines whether or not the data related to the obstacle is acquired by the data acquisition section 80, namely whether or not the obstacle is detected by the rear camera 61, the left camera 62, or the right camera 63 (Step S831).

In a case where it is determined in Step S831 (Step S831/YES) that the obstacle is detected, the calculation section 81 calculates a distance of the obstacle from the vehicle body and an azimuth direction of the obstacle relative to the vehicle body (Step S832).

Next, based on the calculation results in Step S832, the position determination section 83 determines whether or not the obstacle is located in the vehicle/obstacle collision area (the area enclosed by the trajectory X) (Step S833).

In a case where it is determined in step S833 that the obstacle is located in the vehicle/obstacle collision area (Step S833/YES), the rotational state determination section 82 determines, based on the pilot pressure acquired by the data acquisition section 80 and the calculation results given by the calculation section 81, whether or not the hydraulic excavator 1 turns in a direction toward the obstacle (Step S834).

In a case where it is determined in Step S834 that the hydraulic excavator 1 turns in the direction toward the obstacle (Step S834/YES), the operation limiter section 85 outputs the operation limit signal to each of the first solenoid reducing valve 751 and the second solenoid reducing valve 752 (Step S835). Subsequently, the operation limiting process in the controller 8 ends. Thus, the turning operation based on the manipulated variable of the operating lever 420 is limited.

On the other hand, in any of the cases where it is determined in Step S831 that the obstacle is not detected (Step S831/NO), where it is determined in Step S833 that the obstacle is not located in the potential collision area (Step S833/NO), and where it is determined in Step S834 that the hydraulic excavator 1 does not turn in the direction toward the obstacle, namely that the hydraulic excavator turns away from the obstacle (Step S834/NO), the operation limiter section 85 does not limit the operation and the operation limiting process in the controller 8 ends. Accordingly, the turning operation based on the manipulated variable of the operating lever 420 is performed.

As just described, in a case where the enable switch 65 of the hydraulic excavator 1 is not turned ON in the hanging work mode, the operation limiting process by the operation limiter section 85 is disabled by the disable process section 86. Hence, the obstacle avoidance control system is not actuated and the turning operation based on the manipulated variable of the operating lever 420 is performed. During the hanging work, therefore, the following problems are prevented: the obstacle avoidance control system is actuated during the hanging work so that the turning speed is reduced or the turning operation is suddenly stopped, resulting in wide swing of the hanging load on the hook 53A or disengagement and fall of the hanging load from the hook 53A. This ensures that the operator can accomplish the intended hanging work with a sense of security.

According to the embodiment, the operator can turn ON the enable switch 65 to cancel the disabling process performed by the disable process section 86 so as to allow the operation limiter section 85 to perform the operation limiting process even in the hanging work mode. The case where the operation limiting process is performed even in the hanging work mode is assumed to include a case where it is rather preferred to actuate the obstacle avoidance control system even during the hanging work, such as a case where the hanging load is disengaged from the hook 53A (case where no load is hang on the hook 53A), and a case where, at a site of deep digging work or the like, the hanging load is located so deep under the ground relative to the ground surface where the hydraulic excavator 1 is placed.

A condition for proceeding to the operation limiting process rather than to the disabling process even during the hanging work mode can include several methods such as one where the enable switch 65 is manually turned ON by the operator. Such methods will be described in a second embodiment and a third embodiment.

Second Embodiment

Figure 7:
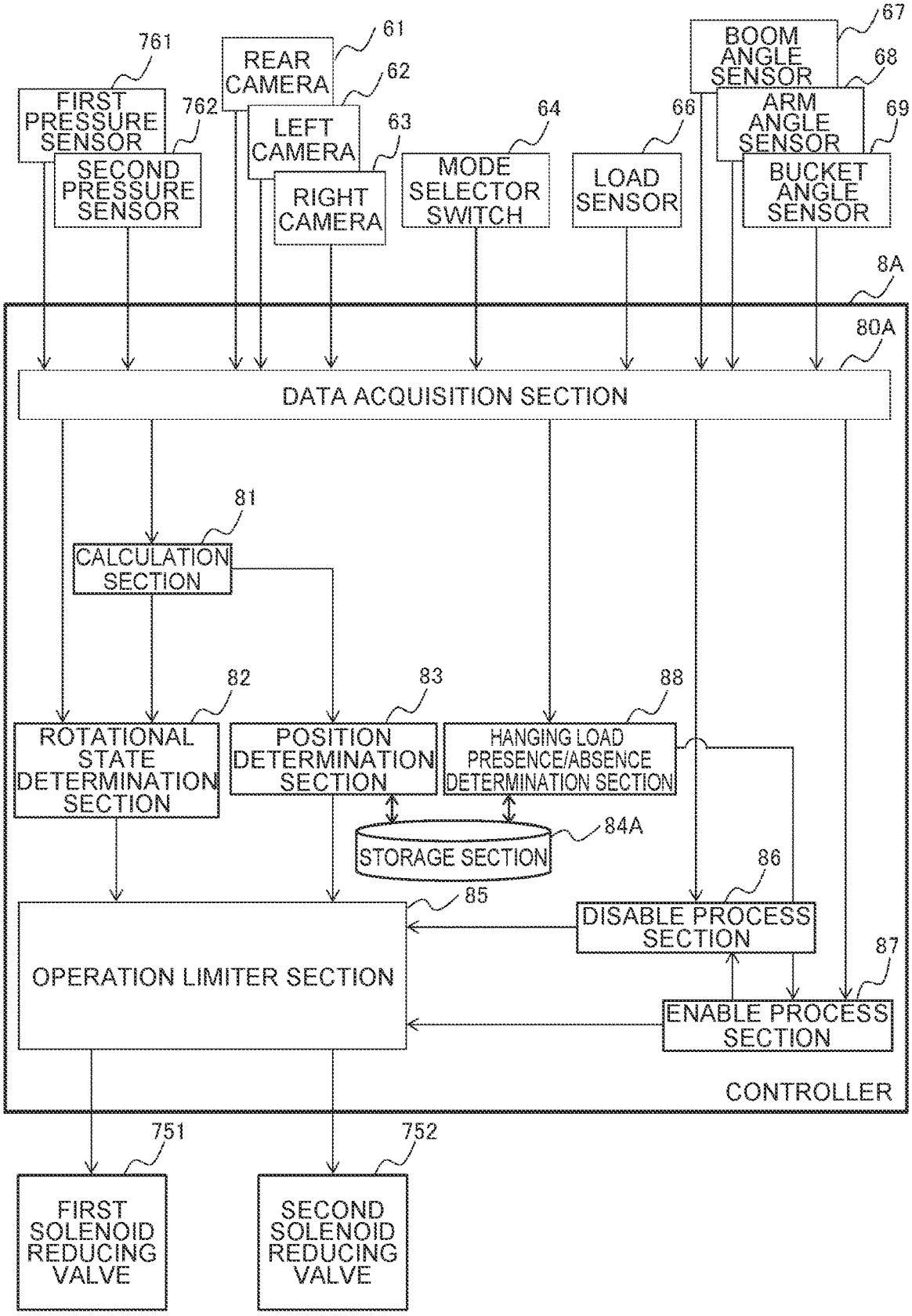
FIG. 7 is a functional block diagram showing the functions of a controller according to a second embodiment hereof.
Figure 8:
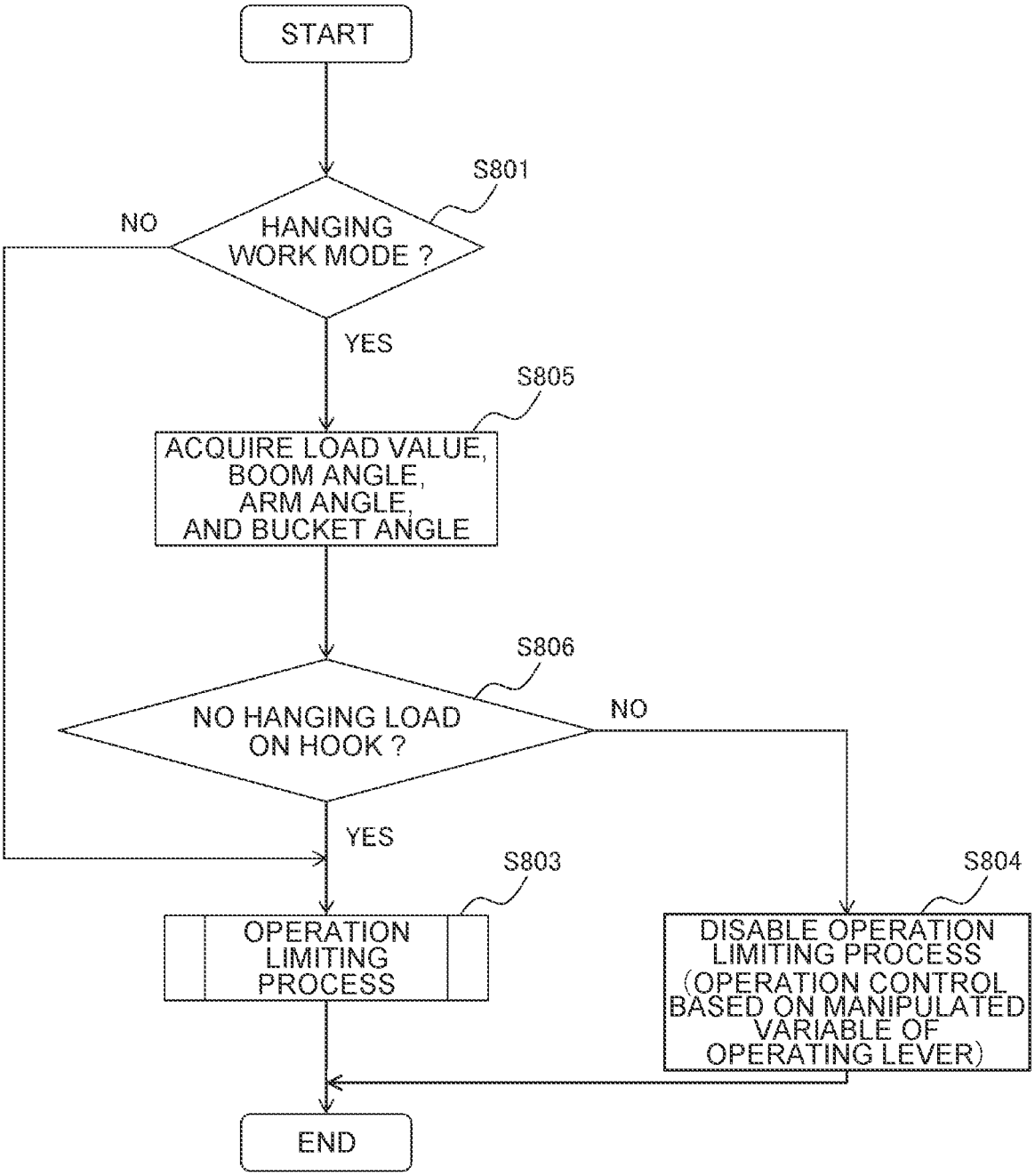
FIG. 8 is a flow chart showing a flow of the whole process performed by the controller according to the second embodiment hereof.

Next, a description is made on a configuration of a controller 8A according to a second embodiment hereof with reference to FIG. 7 and FIG. 8. In FIG. 7 and FIG. 8, identical or equivalent components to those of the controller 8 according to the first embodiment will be referred to by like reference numerals and the description thereof is dispensed with. This applies to a third embodiment as well.

FIG. 7 is a functional block diagram showing functions of the controller 8A according to the second embodiment. FIG. 8 is a flow chart showing a flow of the whole process performed by the controller 8A according to the second embodiment.

As shown in FIG. 7, the controller 8A according to the second embodiment includes a hanging load presence/absence determination section 88. The hanging load presence/absence determination section 88 determines whether or not some load is hang on the hook 53A based on a load value detected by a load sensor 66 for detecting a load on the hook 53A; and an angle detected by a boom angle sensor 67 for detecting an angle of the boom 51 relative to the upperstructure 4, an angle detected by an arm angle sensor 68 for detecting an angle of the arm 52 relative to the boom 51, and an angle detected by a bucket angle sensor 69 for detecting an angle of the bucket 53 relative to the arm 52.

The load sensor 66 detects a load (weight of the hanging load) on the hook 53A by detecting, for example, a bottom pressure of a boom cylinder 510L, 510R. The boom angle sensor 67, the arm angle sensor 68, and the bucket angle sensor 69 are each equivalent to a posture sensor for detecting a posture of the front working device 5.

A storage section 84A stores therein determination threshold values as determination criteria based on which whether the load is hang on the hook 53A or not is determined. The determination threshold values vary according to the posture of the front working device 5, specifically an operating radius of the hydraulic excavator 1 (a length from the axis of rotation of the upperstructure 4 to a predetermined position on the bucket 53), and a height of the front working device 5. It is noted that the determination threshold value does not necessarily have to be the value varying according to the posture of the front working device 5. The determination threshold value may be set to a fixed value regardless of the posture of the front working device 5. The determination threshold value is defined in consideration of balance between the front part and the rear part (counterweight 43) of the vehicle body. In some cases, therefore, the determination threshold value may vary for each weight of the counterweight 43 or for each model of the hydraulic excavator 1.

As shown in FIG. 8, when it is determined in Step S801 that the operation is in the hanging work mode (Step S801/YES), the data acquisition section 80A acquires a load value detected by the load sensor 66, a boom angle detected by the boom angle sensor 67, an arm angle detected by the arm angle sensor 68, and a bucket angle detected by the bucket angle sensor 69 (Step S805).

Next, the hanging load presence/absence determination section 88 determines whether or not the hook 53A is free from the hanging load (Step S806) by determining whether or not the load value acquired by the data acquisition section 80 is equal to or less than the determination threshold value stored in the storage section 84A (Step S806).

In a case where it is determined in Step S806 that the hook 53A is free from the hanging load (Step S806/YES), the operation proceeds to the operation limiting process by the operation limiter section 85 (Step S803). In this case, the controller 8A performs the operation limiting process even during the hanging work mode.

On the other hand, in a case where it is determined in Step S806 that the hook 53A is not free from the load (Step S806 (Step S806/NO), the operation proceeds to the disabling process by the disable process section 86 (Step S804). In this case, the controller 8A controls the turning operation according to the manipulated variable of the operating lever 420.

Even when the hydraulic excavator 1 is performing the hanging work, it is unlikely that the operation limiting process will cause the swing of the hanging load in a state where no load is hang on the hook 53A. Therefore, the obstacle avoidance control system is actuated by enabling the operation limiting process so that the turning operation according to the manipulated variable of the operating lever 420 can be limited.

Third Embodiment

Figure 9:
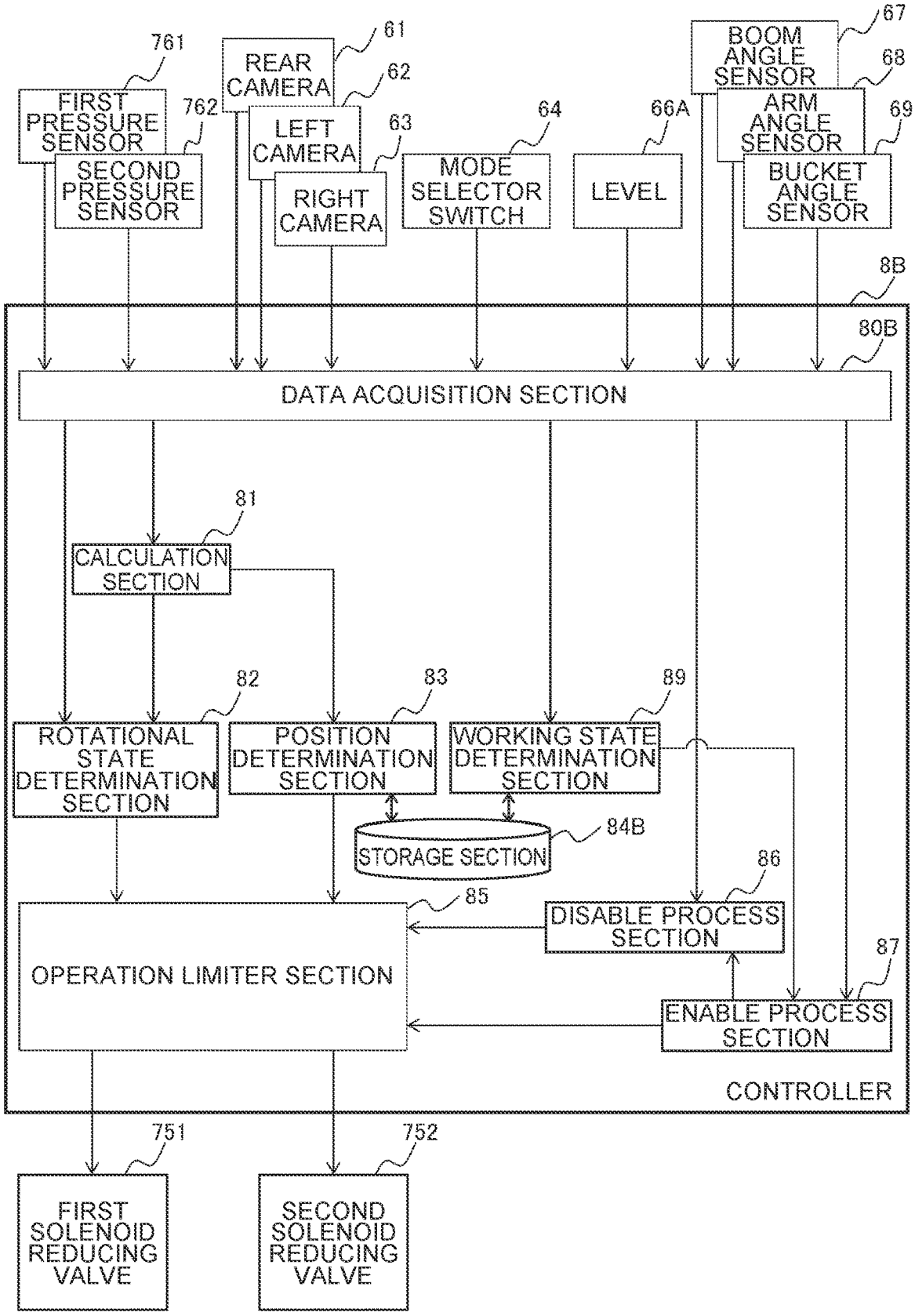
FIG. 9 is a functional block diagram showing the functions of a controller according to a third embodiment hereof.
Figure 10:
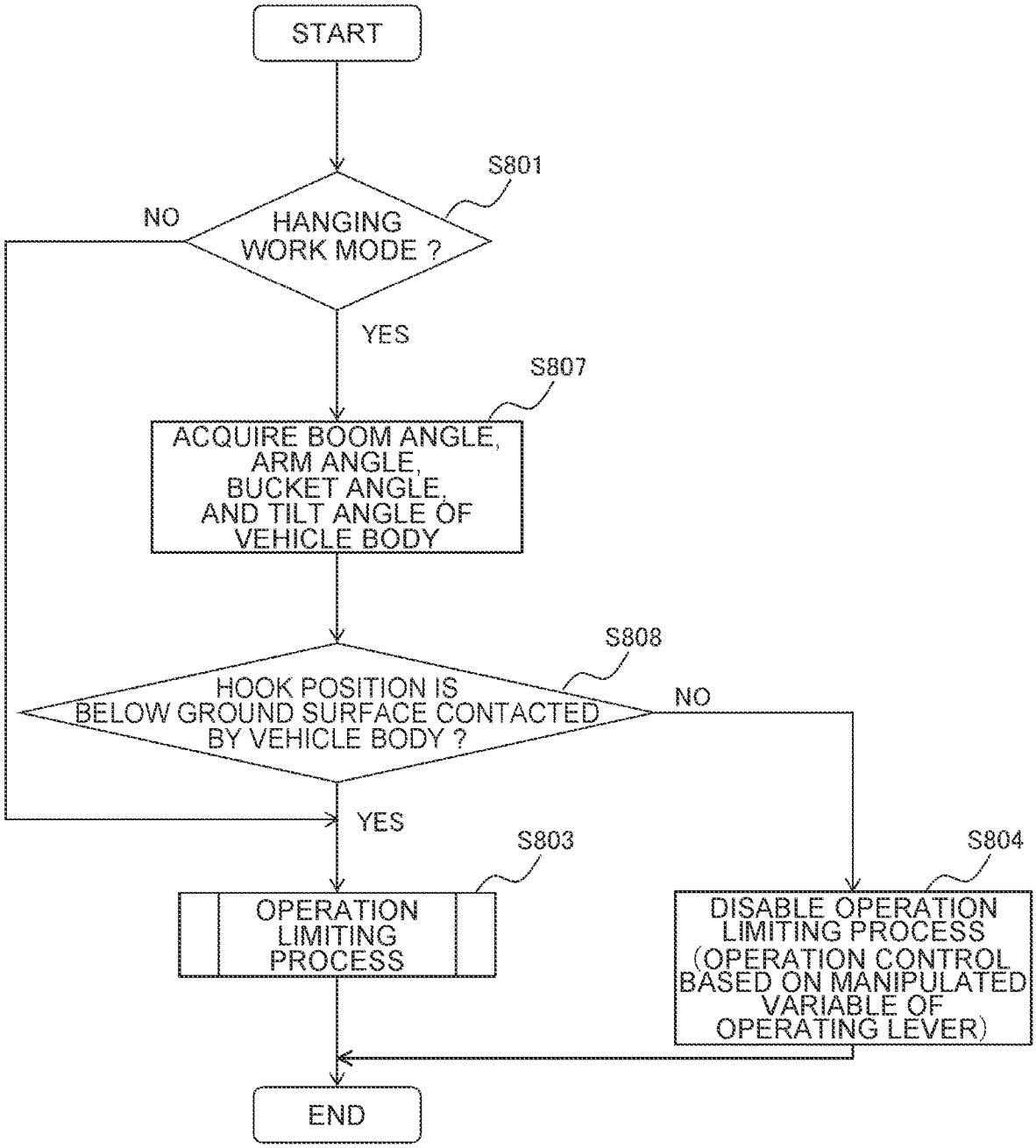
FIG. 10 is a flow chart showing a flow of the whole process performed by the controller according to the third embodiment hereof.

Next, a description is made on a configuration of a controller 8B according to a third embodiment hereof with reference to FIG. 9 and FIG. 10.

FIG. 9 is a functional block diagram showing the functions of the controller 8B according to the third embodiment. FIG. 10 is a flow chart showing a flow of the whole process performed by the controller 8B according to the third embodiment.

As shown in FIG. 9, the controller 8B according to the embodiment includes a working state determination section 89 in place of the hanging load presence/absence determination section 88 according to the second embodiment. The working state determination section 89 determines the posture of the front working device 5 based on a tilt angle of the vehicle body as detected by a level 66A mounted on the vehicle body, a boom angle detected by the boom angle sensor 67, an arm angle detected by the arm angle sensor 68, and a bucket angle detected by the bucket angle sensor 69.

Specifically, when the disabling process by the disable process section 86 is cancelled and the operation limiting process by the operation limiter section 85 is enabled, a posture of the front working device 5 is previously stored in a storage section 84B as an enable threshold value. The working state determination section 89 compares a posture of the front working device 5 relative to the vehicle body with the enable threshold value, the posture of the front working device 5 calculated from the tilt angle of the vehicle body, the boom angle, the arm angle, and the bucket angle acquired by the data acquisition section 80B. The enable threshold value can be defined arbitrarily in a manner to fit in to the circumstances of the site of work. For example, the enable threshold value can be defined by a value in a case where the hook 53A is located below a ground contact surface of the vehicle body of the hydraulic excavator 1.

As shown in FIG. 10, when it is determined in Step S801 that the operation is in the hanging work mode (Step S801/YES), the data acquisition section 80B acquires the tilt angle of the vehicle body as detected by the level 66A, the boom angle detected by the boom angle sensor 67, the arm angle detected by the arm angle sensor 68, and the bucket angle detected by the bucket angle sensor 69 (Step S807).

Next, the working state determination section 89 compares the posture of the front working device 5 relative to the vehicle body with the enable threshold value, the posture calculated based on the individual data pieces acquired in Step S807. By comparing in this manner, the working state determination section 89 determines whether or not the hook 53A is located below the ground contact surface of the vehicle body (Step S808).

In a case where it is determined in Step S808 that the hook 53A is located below the ground contact surface of the vehicle body (Step S808/YES), the operation proceeds to the operation limiting process by the operation limiter section 85 (Step S803). On the other hand, in a case where it is determined in Step S808 that the hook 53A is not located below the ground contact surface of the vehicle body (Step S808/NO), the operation proceeds to the disabling process by the disable process section 86 (Step S804).

In the case where the hook 53A is located below the ground contact surface of the vehicle body, there is no fear at the site of deep digging work or the like, for example, that the hanging load will collide with any worker around the vehicle body if the operation limiting process, performed during the hanging work by the hydraulic excavator 1, causes the swing of the hanging load. It is therefore preferred to enable the operation limiting process even in the hanging work mode. Thus, the embodiment is adapted to permit the operator to perform the operation limiting process depending upon the posture of the front working device 5 even when the hydraulic excavator 1 is performing the hanging work. The embodiment permits the operator to actuate the obstacle avoidance control system at will.

According to the embodiment, the controller 8B calculates the posture (the position of the hook 53A) of the front working device 5 based on the tilt angle of the vehicle body as detected by the level 66A, the boom angle detected by the boom angle sensor 67, the arm angle detected by the arm angle sensor 68, and the bucket angle detected by the bucket angle sensor 69. However, the tilt angle of the vehicle body detected by the level 66A is not always necessary as a calculation parameter. Without using the tilt angle of the vehicle body as detected by the level 66A, the posture of the front working device 5 may be calculated only based on the boom angle detected by the boom angle sensor 67, the arm angle detected by the arm angle sensor 68, and the bucket angle detected by the bucket angle sensor 69.

The embodiments of the present invention have been described as above. It is noted that the present invention is not limited to the foregoing embodiments and includes a variety of modifications. The foregoing embodiments, for example, are the detailed illustrations to clarify the present invention. The present invention is not necessarily limited to those including all the configurations described above. A part of a configuration of the embodiments can be replaced by a configuration of another embodiment. Further, a configuration of the embodiments can be added to the arrangement of another embodiment. A part of an arrangement of each embodiment permits addition of some component of another embodiment, the omission thereof or replacement thereof.

For example, the foregoing embodiments illustrate the hydraulic excavator 1 as one aspect of the construction machine. However, the present invention is not limited to this and is also applicable to other construction machines.

The foregoing embodiments illustrate the turning operation of the hydraulic excavator 1 by way of example. However, the present invention is not limited to this and is also applicable to a variety of operations of the hydraulic excavator 1 such as forward and backward movements of the vehicle body, and the operation of the front working device 5.

The controller 8, 8A, 8B according to the foregoing embodiments controls the disable process section 86 to disable the operation limiting process by the operation limiter section 85 during the hanging work mode, and controls the turning operation according to the manipulated variable of the operating lever 420. However, the present invention is not limited to this. During the hanging work mode, for example, the operation limiter section 85 may be programmed right from the start not to perform the operation limiting process (not to enable the operation limiting process).

The controller 8, 8A, 8B according to the foregoing embodiments includes the enable process section 87 but does not necessarily have to include the enable process section 87. In a case where at least the switching signal from the mode selector switch 64 is acquired, or when the excavator is in the hanging work mode, the controller does not have to execute the operation limiting process but only has to control the turning operation according to the manipulated variable of the operating lever 420.

LIST OF REFERENCE SIGNS

1 hydraulic excavator (construction machine)
2 undercarriage (vehicle body)
3 upperstructure (vehicle body)
5 front working device (working device)
8, 8A, 8B controller
53A hook (hanging attachment)
61 rear camera (obstacle detection sensor)
62: left camera (obstacle detection sensor)
63 right camera (obstacle detection sensor)
64 mode selector switch (mode selection device)
65 enable switch (enable device)
66 load sensor
67 boom angle sensor (posture sensor)
68 arm angle sensor (posture sensor)
69 bucket angle sensor (posture sensor)
420 operating lever (operating device)

The invention claimed is:

1. A construction machine comprising:
a vehicle body;
a working device attached to the vehicle body;
an operating device for operating the vehicle body and the working device;
an obstacle detection sensor for detecting any obstacle present around the vehicle body; and
a controller for controlling operations an operation of the vehicle body and an operation of the working device,
the controller performing an operation limiting process for limiting the operation for moving the working device in a direction toward the obstacle by the operating device in a case where the obstacle detection sensor detects the obstacle, the construction machine further comprising:
a hanging attachment attached to the working device;
a mode selection switch for switching a work mode to a hanging work mode to perform hanging work using the hanging attachment;
a load sensor for detecting a load on the hanging attachment; and
a posture sensor for detecting a posture of the working device,
wherein
in a case where the obstacle detection sensor detects the obstacle, in a state where the work mode has not been switched to the hanging work mode by the mode selection switch, the controller performs the operation limiting process to limit the operation of the vehicle body and the operation of the working device,
in the case where the obstacle detection sensor detects the obstacle, in a state where the work mode has been switched to the hanging work mode by the mode selection switch and the controller determines, based on a load value detected by the load sensor and the posture of the working device as detected by the posture sensor, that no load is hanging on the hanging attachment, the controller performs the operation limiting process to limit the operation of the vehicle body or the operation of the working device according to a manipulated variable of the operating device, and
in a case where the obstacle detection sensor detects the obstacle, in a state the work mode has been switched to the hanging work mode by the mode selection switch and the controller determines, based on the load value detected by the load sensor and the posture of the working device as detected by the posture sensor, that the load is hanging on the hanging attachment, the controller controls the operation of the vehicle body or the operation of the working device according to a manipulated variable of the operating device, with always disabling the operation limiting process.

2. The construction machine according to claim 1,
wherein the controller stores therein a determination threshold value as a determination criterion based on whether the load is hanging on the hanging attachment or not, and
the determination threshold value varies according to the posture of the working device.

* * * * *